United States Patent [19]

Olson

[11] Patent Number: 5,029,546

[45] Date of Patent: Jul. 9, 1991

[54] METHOD AND APPARATUS FOR WATER JET TRIM ON BOATS

[75] Inventor: Jeffrey A. Olson, Vernon Hills, Ill.

[73] Assignee: Outboard Marine Corporation, Waukegan, Ill.

[21] Appl. No.: 538,574

[22] Filed: Jun. 15, 1990

[51] Int. Cl.[5] ..... B63H 25/46

[52] U.S. Cl. ..... 114/151; 440/38

[58] Field of Search ..... 114/122, 151; 440/38–42; 60/220, 221

[56] References Cited

U.S. PATENT DOCUMENTS

| | | | |
|---|---|---|---|
| 2,190,617 | 2/1940 | von den Steinen | 114/151 |
| 2,330,674 | 9/1943 | Briggs | 114/151 |
| 3,176,648 | 4/1965 | Cavero | 440/42 |
| 3,339,516 | 9/1967 | Lenci | 440/39 |
| 3,827,389 | 8/1974 | Kureth | 440/42 |
| 4,807,552 | 2/1989 | Fowler | 440/38 |

*Primary Examiner*—Jesus D. Sotelo

*Attorney, Agent, or Firm*—Welsh & Katz, Ltd.

[57] ABSTRACT

A method and apparatus for trimming a boat to adjust the angle of attack of the boat relative to the water, which comprises passing the boat through the water at a speed sufficient to cause an intake conduit located on the after portion of the hull, and preferably at the stern of the boat to receive water. The received water is passed from the stern via a transfer conduit to the bow of the boat. The received water is then expelled downwardly out of the bow via a discharge nozzle at a velocity sufficient to create a reaction force great enough to create a bow-lifting moment upon the boat hull. In addition, the trim system can control the velocity of flow of the water expelled from the discharge nozzle to thereby control the reaction force and the bow-lifting moment.

14 Claims, 2 Drawing Sheets

METHOD AND APPARATUS FOR WATER JET TRIM ON BOATS

BACKGROUND OF THE INVENTION

The present invention relates to a method and apparatus for adjusting the trim on a powerboat. More particularly, the present invention relates to a method and apparatus for adjusting the trim on a powerboat that is powered by an outboard motor.

Most powerboats on the marketplace today include a trim system which allows the operator to adjust the angle of attack of the boat relative to the water. Such powerboats are generally stern driven powerboats which include outboard, stern drive, jet drive, and inboard driven boats. Adjustment of the trim system is usually accomplished by means of a hydraulic actuator which adjusts the angle of the motor relative to the boat. Normally, the maximum boat speed is attained with the outdrive trimmed "out", so that the direction of thrust creates a bow-lifting moment about the center of lift. (This is more fully discussed hereinafter in relation to FIG. 2.) As the bow is lifted, water drag forces are reduced and the boat speed increases.

Although this system is effective, this method possesses several disadvantages. First, as the drive unit is trimmed out, the direction of thrust departs from the direction of boat motion. The result is a loss in useful thrust. Additionally, as the drive unit is trimmed out, a portion of the thrust acts in a downward direction. This adds to the effective weight of the boat and pushes the stern of the boat deeper into the water, thereby increasing water drag forces. Moreover, as the drive unit is trimmed out, the effective pitch of the propeller blades becomes unbalanced. That is, the effective pitch of the blades on the port side is increased with standard propeller rotation, while the effective pitch of the blades on the starboard side is reduced. This results in undesirable steering torque and a drop in propeller efficiency. Finally, the hydraulic trim mechanism is expensive.

Accordingly, it is an object of the present invention to provide an improved method and apparatus for trimming a stern drive or an outboard motor driven boat while minimizing the loss of useful thrust.

It is another object of the present invention to provide an improved method and apparatus for trimming a boat moving in the water while minimizing water drag forces.

Yet a further object of the present invention is to provide an improved method and apparatus for trimming a boat moving in the water without producing unbalanced pitch of the propeller blades, undesirable steering torque, and loss in propeller efficiency.

It is an additional object of the present invention to provide a method and apparatus for trimming a boat moving in the water, where the apparatus is relatively inexpensive.

These and other objects of the invention, as well as the advantages thereof, will become apparent from the following description, when taken in conjunction with the illustrated drawings, in which:

FIG. 1 is a simplified schematic representation shown as a partially cut away side elevational view of an embodiment of the present invention, and, FIG. 2 is a simplified schematic representation shown as a side elevational view wherein an outboard motor driven boat has a conventional trim system.

SUMMARY OF THE INVENTION

The objects of the present invention are achieved by apparatus which includes a water intake scoop located in the water at the stern in front of the motor gear case of the out drive portion of the motor, whether it is an outboard motor or a stern drive. The scoop is connected through a water transfer conduit to a discharge nozzle which is placed as far forward on the boat as possible. The nozzle is pointed downward toward the water surface at a selected angle which may be about 90° relative to the longitudinal axis of the boat. A flow control valve is placed in the water transfer conduit between the intake water scoop and the discharge nozzle.

When the boat is moving and the control valve is open, water is picked up at the intake scoop and directed to the discharge nozzle, where it is expelled at a velocity that is a function of the speed at which the boat is being driven. In accordance with Newton's Third Law of Dynamics, which asserts that for every action there is an equal and opposite reaction, a reaction force is created which tends to lift the bow of the boat out of the water. The magnitude of this reaction force is controlled by the speed of the boat and the position of the control valve. The wider the valve is open, the greater the bow-lifting force. If it is closed completely, the force is obviously zero. Regulation of the valve with the boat underway provides trim control which is equivalent to that currently provided by presently available commercial systems.

Thus, in its method aspects, the present invention may be defined as a method of trimming a boat having a hull, a bow, and a stern, to adjust the angle of attack of the boat relative to the water, which comprises passing the boat through the water at a speed sufficient to cause the forward facing scoop located on the aft portion of the hull to take in water, and preferably at the stern of the boat. The intake water is passed via a transfer conduit means from the stern to the bow of the boat. The intake water is then expelled downwardly out of the bow via a discharge means at a velocity sufficient to create a reaction force great enough to create a bow-lifting moment upon the boat hull.

In addition, the method further includes controlling the velocity of flow of the water expelled from the discharge nozzle to thereby control the reaction force and the bow-lifting moment.

In its apparatus aspects, the present invention comprehends apparatus for installation in a boat which allows the boat operator to adjust the angle of attack of the moving boat relative to the water which comprises a water intake conduit means on the aft portion of the boat hull, and preferably at the stern, for taking on water as the boat travels therethrough. A water transfer conduit means is provided in flow communication with the intake conduit means for passing intake water from the stern to the bow of the boat. A water discharge conduit means, preferably configured as a nozzle, is located in the bow in flow communication with the transfer conduit means, for receiving intake water from the stern and expelling the intake water downwardly from the bow at a velocity sufficient to create a reaction force great enough to create a bow-lifting moment upon the boat hull. Of course, the boat clearly must have a boat motor at the stern having power sufficient to drive the boat forward at a velocity sufficient to cause water to enter the intake conduit means, pass through the transfer conduit means, and exit via the water discharge nozzle to thereby create the reactive force.

As previously noted, the boat preferably also includes flow control means for adjusting the velocity of the water which is expelled through the discharge nozzle on the bow of the boat. In addition, it is necessary that the water intake conduit be facing in the forward direction in order to maximize the velocity at which the water enters the boat trim system of this invention.

DESCRIPTION OF THE PREFERRED EMBODIMENTS

Figure 2:
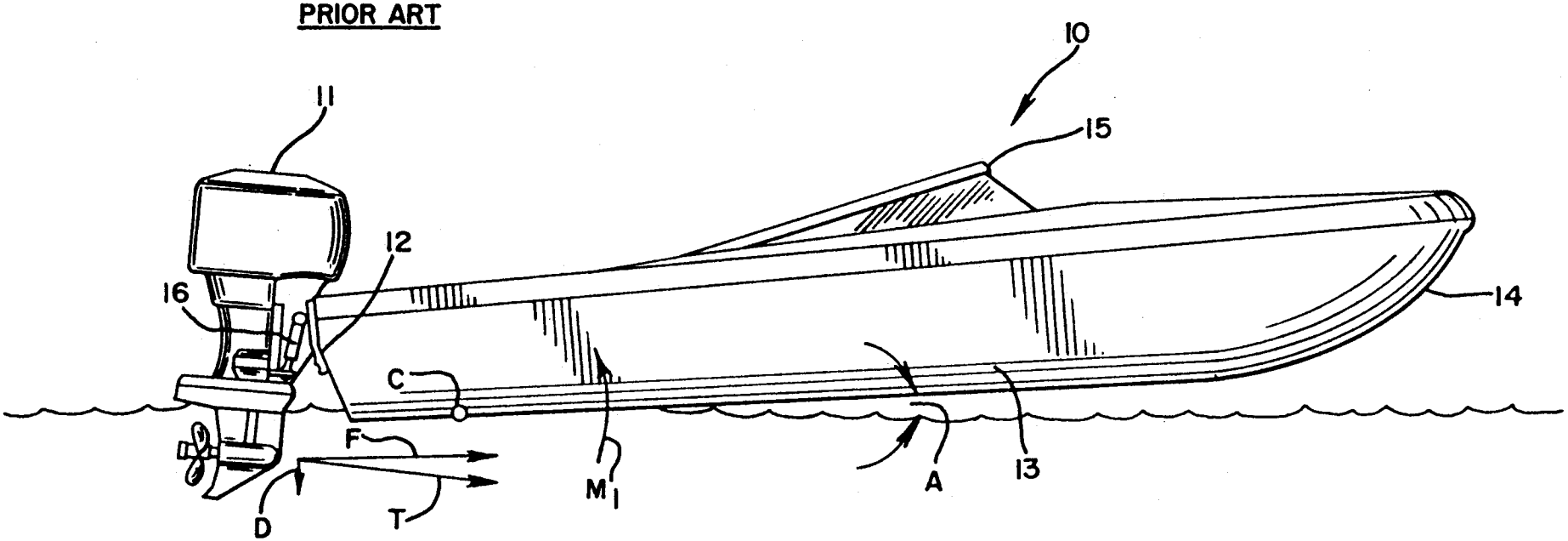
FIG. 2 PRIOR ART

Turning now to the drawings, FIG. 2 is a simplified schematic representation in side elevation illustrating a powerboat 10 driven by an outboard motor 11 mounted on the stern 12 of the boat. The stern 12 and the after portion of the hull 13 are shown immersed in the water while the bow 14 and the forward portion of the hull 13 are shown raised out of the water. This attitude shows that the boat is moving through the water at a substantial rate of speed, with an angle of attack A. The top side of the boat has a windshield 15 surrounding the front and the forward portion of the sides of the passenger compartment.

A hydraulic actuator 16 of a conventional trim system is mounted on the stern of the boat for adjusting the degree of tilt of the outboard motor 11 in relation to the boat. As the hydraulic actuator 16 tilts the motor, the propeller thrust force T continues to drive the boat forward, but the propeller thrust force is not parallel to the water surface. The propeller thrust force is at an angle because of the tilt of the motor in relation to the boat. It has a forward vector component F and a downward vector component D. Therefore, a bow-lifting moment $M_1$ is created about the center of lift C which lifts the bow out of the water to reduce drag and thereby increase speed. As the bow is lifted, the lifting moment causes the stern to sink deeper into the water and this adds to the effective weight of the boat. Thus, as the drive unit has been trimmed out, a loss in useful thrust has occurred.

Figure 1:
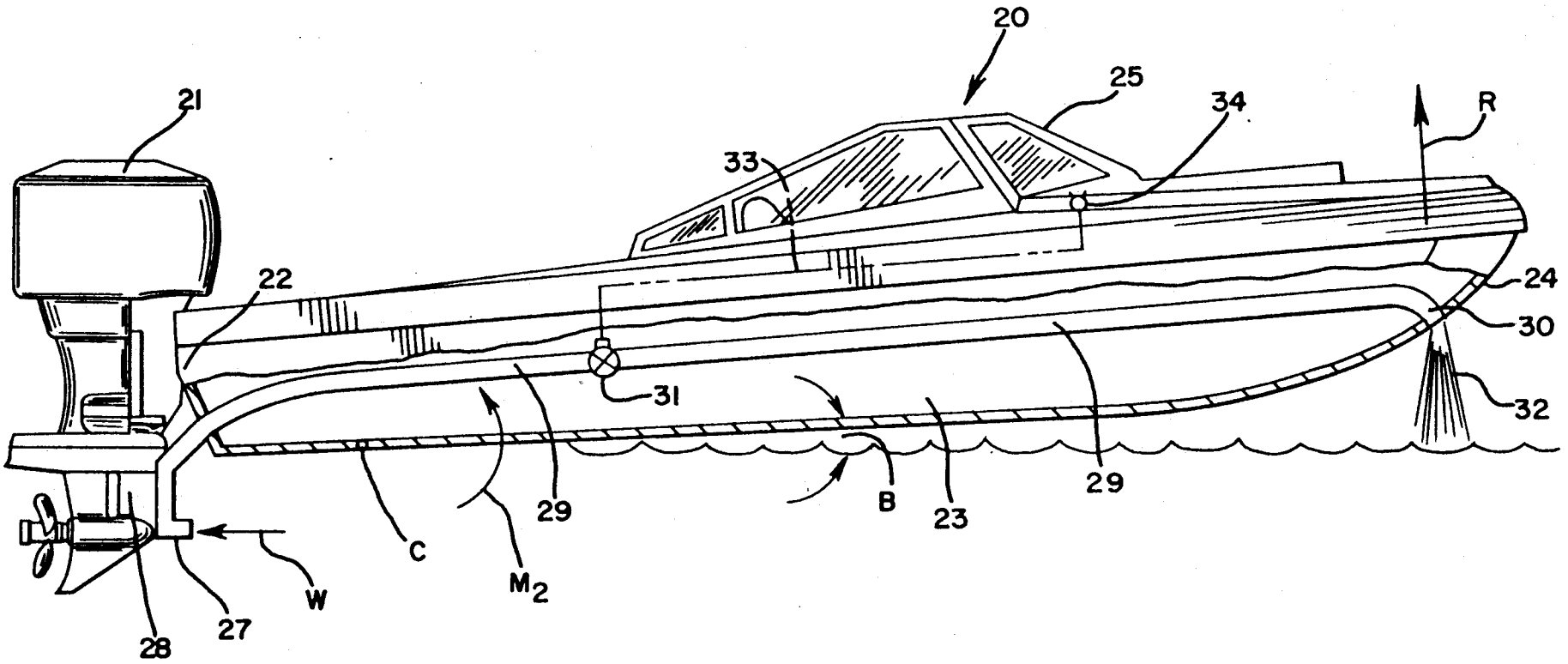

A simplified schematic representation in side elevation is shown in FIG. 1, and illustrates a boat containing the water jet trim system of the present invention. The powerboat 20 is driven by an outboard motor 21 mounted on the stern 22 of the boat. The boat has a hull 23, a bow 24, and a windshield 25 surrounding the front and the forward portion of the sides of the passenger compartment. The stern 22 and the aft portion of the hull 23 are shown immersed in the water. This attitude shows that the boat is moving through the water at a substantial rate of speed with an angle of attack B.

The boat additionally has an intake scoop 27 positioned at the stern of the boat adjacent the gear case 28 of the outboard motor, which scoop 27 receives water as shown by the arrow W when the boat is driven through the water. A water transfer conduit 29, having a smooth inner surface to minimize friction, transfers the water forwardly to the bow of the boat where it is expelled at high velocity from the water nozzle 30. The water is expelled downwardly and the nozzle 30 is pointed at a selected angle which may be about 90° to the longitudinal axis of the boat. A flow control valve 31 is contained within the water transfer conduit 29 for adjusting the velocity of the jet of water 32 being expelled from the nozzle 30. The valve may be adjusted by means of a valve control means 33, which is shown as a phantom line, and which may be a mechanical linkage or a hydraulic interconnection or the like. The water valve adjusting means includes an adjustment knob 34 or the like located in the dashboard or other convenient location that is in close proximity of the operator of the boat.

When the boat is moving and the valve 21 is open, the water W is picked up at the scoop 27 and directed to the nozzle 30 where it is expelled at high velocity. In accordance with Newton's Third Law of Dynamics, which asserts that for every action there is an equal and opposite reaction, a reaction force indicated by the arrow R creates a moment $M_2$ about the center of lift C to thereby lift the bow out of the water. The magnitude of the reaction force R is controlled by the control valve 31. Thus, the wider the valve 31 is open, the greater the bow-lifting ability of the reaction force R to increase the angle of attack B, and the more the valve is pinched off, the lower the lifting force. If the valve is completely closed, the force is Zero. Regulation of the valve 31 with the boat underway in this manner, provides trim control equivalent to that provided by presently available trim systems. The thrust angle of the outdrive can be kept in an optimum position and the need for expensive trim system hydraulics is eliminated.

Since it may be advantageous to retrofit existing powerboats having conventional trim systems with the apparatus of the present invention, those skilled in the art will recognize that the present invention may further comprehend a retrofitting kit for mounting the inventive trim system on a boat. The kit would comprise an intake conduit means to be mounted on a boat hull at the stern of the boat for taking on water as the boat passes therethrough. It would further include a water transfer conduit means to be mounted on the boat for passing intake water from the stern to the bow of the boat, and finally it would include a water discharge conduit means, typically a jet nozzle, for mounting on the bow of the boat for receiving water from the intake conduit means via the transfer conduit means and expelling the intake water downwardly from the boat bow at a velocity sufficient to create a reaction force great enough to create a bow-lifting moment upon the hull of the boat.

In accordance with this invention, such a retrofitting kit would further include flow control means for regulating the velocity of water expelled from the water discharge nozzle. In addition, the kit would include means for mounting the intake conduit on the boat.

In light of the foregoing disclosure, further alternative embodiments of the present invention will undoubtedly suggest themselves to those skilled in the art. It is thus intended that the disclosure be taken as illustrative only, and that it not be construed in any limiting sense. Modifications and variations may be resorted to without departing from the spirit and the scope of this invention, and such modifications and variations are considered to be within the purview and the scope of the appended claims.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. A method of trimming a power boat having a hull, a bow, and stern, to adjust the angle of attack of the boat relative to the surface of water through which the boat is being driven, which comprises:

a) driving the boat through the water at a speed sufficient to cause a forward directed water intake conduit means located on the aft portion of the hull of the boat to receive water;

b) passing the received water via a transfer conduit means, from the intake conduit means to the bow of the boat; and, c) expelling said received water downwardly out of said bow via discharge conduit means at a velocity sufficient to create a reaction force great enough to create a bow-lifting moment upon the boat hull.

2. A method as defined in claim 1 wherein the intake conduit means is located at the stern of the boat.

3. A method as defined in claim 1 wherein the boat is a stern driven powerboat.

4. A method as defined in claim 3 wherein said stern driven powerboat is selected from the group consisting of outboard, stern drive, jet drive, and inboard driven boats.

5. A method as defined in claim 1 further including controlling the velocity of flow of water expelled from the discharge conduit means to thereby control the reaction force and the bow lifting moment.

6. A method as defined in claim 5 wherein the transfer conduit means includes flow control means for controlling the velocity of flow of water expelled, and the flow control means is adjusted for controlling the velocity.

7. Apparatus for use with a power driven boat having a hull, a bow and a stern, for adjusting the angle of attack of the boat relative to the water during forward movement thereof, said apparatus comprising:

forward facing intake conduit means on the aft portion of the hull for receiving water as the boat is driven forwardly through the water;

transfer conduit means in flow communication with said intake conduit means for passing received water from said intake conduit means to the bow of the boat; and, discharge conduit means located in the bow in flow communication with said transfer conduit means, for expelling the received water downwardly from the bow at a velocity sufficient to create a reaction force sufficient to create a bow-lifting moment upon the boat hull.

8. Apparatus as defined in claim 7 wherein said intake conduit means is located at the stern of the boat.

9. Apparatus as defined in claim 7 wherein said discharge conduit means is directed downwardly at a selected angle of about 90° relative to the longitudinal axis of the boat.

10. Apparatus as defined in claim 7 further including flow control means for adjusting the velocity of said expelled intake water.

11. Apparatus as defined in claim 10 wherein said flow control means comprises a valve operable to adjust the volume of water flowing through each of said conduit means.

12. Apparatus as defined in claim 11 wherein said flow control means is located in said transfer conduit means.

13. Apparatus as defined in claim 11 further including operator adjustment means operatively coupled to said valve and being capable of adjusting said valve from a location distant from said valve.

14. Apparatus as defined in claim 13 wherein said operator adjustment means is located in proximity to the operator of the boat.

* * * * *